US008404358B2

(12) United States Patent
Kurosaki et al.

(10) Patent No.: US 8,404,358 B2
(45) Date of Patent: Mar. 26, 2013

(54) GALVANNEALED STEEL SHEET AND PRODUCING METHOD THEREFOR

(75) Inventors: Masao Kurosaki, Tokyo (JP); Jun Maki, Tokyo (JP); Hiroyuki Tanaka, Tokyo (JP); Shintaroh Yamanaka, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 30 days.

(21) Appl. No.: 13/138,309

(22) PCT Filed: Jul. 9, 2009

(86) PCT No.: PCT/JP2009/062538

§ 371 (c)(1),
(2), (4) Date: Jul. 28, 2011

(87) PCT Pub. No.: WO2010/089910

PCT Pub. Date: Aug. 12, 2010

(65) Prior Publication Data

US 2011/0284136 A1 Nov. 24, 2011

(30) Foreign Application Priority Data

Feb. 3, 2009 (JP) ..... 2009-022920
Feb. 4, 2009 (JP) ..... 2009-023603

(51) Int. Cl.
*C21D 6/00* (2006.01)
*B32B 15/01* (2006.01)

(52) U.S. Cl. ..... 428/659; 428/469; 148/533; 148/537; 148/661

(58) Field of Classification Search ..... 148/533, 148/537, 661; 428/659, 469; 427/433, 436
See application file for complete search history.

(56) References Cited

U.S. PATENT DOCUMENTS 5,155,751 A * 10/1992 Chohata et al. ..... 378/71
5,525,431 A 6/1996 Kanamaru et al.
6,368,728 B1 * 4/2002 Tobiyama et al. ..... 428/659
2007/0051438 A1 3/2007 Honda et al.

FOREIGN PATENT DOCUMENTS

JP 53-060332 5/1978
JP 03-191093 8/1991

(Continued)

OTHER PUBLICATIONS

International Search Report dated Sep. 15, 2009 issued in corresponding PCT Application No. PCT/JP2009/062538.

(Continued)

*Primary Examiner* — Deborah Yee
(74) *Attorney, Agent, or Firm* — Kenyon & Kenyon LLP

(57) ABSTRACT

A galvannealed steel sheet includes: a steel sheet; a galvannealed layer; and a Mn—P based oxide film. A Zn—Fe alloy phase in the galvannealed layer is measured by X-ray diffractometry. The value of a diffraction intensity Γ(2.59 Å) of Γ phase divided by a diffraction intensity $\delta_1$(2.13 Å) of $\delta_1$ phase is less than or equal to 0.1. The value of a diffraction intensity ζ(1.26 Å) of ζ phase divided by a diffraction intensity $\delta_1$(2.13 Å) of $\delta_1$ phase is greater than or equal to 0.1 and less than or equal to 0.4. The Mn—P based oxide film is formed using 5 to 100 mg/m$^2$ of Mn and 3 to 500 mg/m$^2$ of P on a surface of the galvannealed layer.

7 Claims, 6 Drawing Sheets

FOREIGN PATENT DOCUMENTS

| | | |
|---|---|---|
| JP | 03-249182 | 11/1991 |
| JP | 06-088187 | 3/1994 |
| JP | 6-088190 | 3/1994 |
| JP | 07-041925 | 2/1995 |
| JP | 08-296065 | 11/1996 |
| JP | 09-165662 | 6/1997 |
| JP | 10-096064 | 4/1998 |
| JP | 10-306360 | 11/1998 |
| JP | 2002-294421 | 10/2002 |
| JP | 2004-169160 | 6/2004 |
| JP | 2005-048198 | 2/2005 |
| JP | 2005-054199 | 3/2005 |
| JP | 2007-131910 | 5/2007 |
| JP | 2008-231448 | 10/2008 |
| RU | 2323266 C2 | 4/2008 |
| TW | 573021 | 1/2004 |

OTHER PUBLICATIONS

European Search Report dated May 4, 2012, issued in corresponding European Application No. EP 09839684.

Russian Decision on Grant dated May 10, 2012, issued in corresponding Russian Application No. RU 2011132122, and an English translation thereof.

Taiwanese Office Action dated Oct. 9, 2012, issued in corresponding Taiwanese Application No. 098123063, and an English translation thereof.

* cited by examiner

GALVANNEALED STEEL SHEET AND PRODUCING METHOD THEREFOR

BACKGROUND OF THE INVENTION

1. Field of the Invention

The present invention relates to a galvannealed steel sheet used by press-forming for automobiles, home electrical appliances, building materials, and the like, and a producing method therefor, and, in particular, to a galvannealed steel sheet having an excellent sliding property (a flaking resistance), powdering resistance, chemical conversion treatability, and no uneven appearance, and a producing method therefor. This application is a national stage application of International Application No. PCT/JP2009/062538, filed on Jul. 9, 2009, which claims priority to Japanese Patent Application No. 2009-023603, filed on Feb. 4, 2009, and Japanese Patent Application No. 2009-022920, filed on Feb. 3, 2009, the contents of which are incorporated herein by reference.

2. Description of Related Art

A galvannealed steel sheet has excellent weldability and coatability in comparison with a galvanized steel sheet. Therefore, the galvannealed steel sheet is widely used in a wide range of fields as an automobile body as a principal use, home electrical appliances, building materials, and the like.

The galvannealed steel sheet is produced by heating treatment after hot dip galvanization of a steel sheet in order to form an Fe—Zn alloy layer on the surface of a steel sheet. By the heat treatment, alloying reaction is initiated through interdiffusion of Fe in a steel sheet and Zn in a galvanizing layer. It is said that the alloying reaction is preferably initiated from grain boundaries of a steel sheet. However, if many elements segregated easily in grain boundaries (grain boundary segregation elements) are contained in a steel sheet, interdiffusion of Fe and Zn is locally prevented. Therefore, an alloying reaction becomes heterogeneous, and thereby there is a difference in the thickness of a galvannealed layer formed. Since a linear defect appears by the difference in the thickness of a galvannealed layer, the quality of the steel sheet is poor due to an uneven appearance derived from a linear defect. In particular, there is a problem in that the unevenness easily appears in a steel sheet containing many grain boundary segregation elements such as P for the purpose of increasing the strength of a steel sheet in recent years. The problem attributes to constraint of interdiffusion of Fe and Zn in concentrated zones of P during alloying of a galvanizing layer by heterogeneous concentration of P in areas of surfaces and grain boundaries of a steel sheet in heating of a steel sheet. Therefore, the rate of an alloying reaction between Fe and Zn varies with location, and thereby there is a difference in the thickness of a galvannealed layer formed. The addition of inexpensive Si and/or Mn is widely used as a strengthening method for steel products. However, if the amount of Si in a steel sheet is more than 0.3 mass %, the wettability of a galvannealed layer is decreased significantly. Therefore, there is the problem in that quality of a galvannealed layer is poor and the quality of appearance is deteriorated.

For this reason, various galvannealed steel sheets having excellent quality of appearance has been investigated. For example, it is known that a method for producing a galvannealed steel sheet by dipped in a hot galvanizing bath after the surface of a steel sheet to be galvanized is ground so that an arithmetical mean deviation of profile (Ra) may be from 0.3 to 0.6 (for example, Patent Citation 1) and a method of forming a metallic coating layer such as Fe, Ni, Co, and Cu before hot dip galvanizing of an annealed steel sheet (for example, Patent Citation 2). However, in these methods, there is a problem in that since the extra process before hot dip galvanizing is required, the number of total processes increases and the cost increases with an increased number of facilities.

Typically, a galvannealed steel sheet is used after press-forming. However, a galvannealed steel sheet has a disadvantage of poor press formability compared with a cold-rolled steel.

The poor press formability results from a composition of a galvannealed layer. Typically, a Zn—Fe alloy layer formed by alloying reaction, which is diffused Fe in a steel sheet into Zn in a galvanizing layer, is a galvannealed coating layer (galvannealed layer) composed of Γ phase, $\delta_1$ phase, and ζ phase. In order of decreasing an Fe concentration, the galvanized coating layer is composed of Γ phase, $\delta_1$ phase, and ζ phase. In the order, the hardness and the melting point of each phase are decreased. Hard and brittle Γ phase is formed in an area of the galvannealed layer in contact with the surface of the steel sheet (an interface between the galvannealed layer and the steel sheet), and soft ζ phase is formed in an upper area of the galvannealed layer. ζ phase is soft and thereby adheres to press die easily, and has a high coefficient of friction and thereby has a bad sliding property. Therefore, when difficult press-forming is performed, ζ phase results in a phenomenon (flaking) in which a galvannealed layer adheres to a die and peels. Γ phase is hard and brittle, and thereby results in powdery peeling (powdering) of a galvannealed layer in press-forming.

A good sliding property is important in press-forming of a galvannealed steel sheet. Therefore, in view of the sliding property, an effective technique is that a galvanizing layer is alloyed to a high degree and thereby becomes a high Fe concentration layer having a high hardness, melting point, and adhesion resistance. However, powdering is caused by this technique in a galvannealed steel sheet produced thereby.

In view of powdering resistance, an effective technique is that a galvanizing layer is alloyed to a low degree and thereby has a low Fe concentration layer in which formation of Γ phase is suppressed which suppresses powdering. However, a galvannealed steel sheet produced by this technique has a poor sliding property and the poor sliding property results in flaking.

Therefore, both opposite properties of sliding property and powdering resistance are required so that a galvannealed steel sheet may have good press formability.

As a technique for improvement of press formability of a galvannealed steel sheet, a producing method (for example, the Patent Citation 3) for a galvannealed steel sheet having $\delta_1$ phase mainly is proposed. In the producing method, in a bath with a high Al concentration, galvanization is performed at a high temperature determined by the Al concentration, so that an alloying reaction may be suppressed, and then an alloying treatment, in which the temperature of a steel sheet is in the range of 460° C. to 530° C. at the exit of an alloying furnace which uses high-frequency induction heating, is executed. In addition, a producing method (for example, the Patent Citation 4) for a galvannealed steel sheet on which a galvannealed layer of single $\delta_1$ phase is formed is proposed. In the producing method, a hot dip galvanized steel sheet is held for 2 seconds to 120 seconds in a temperature area from 460° C. to 530° C. as soon as hot dip galvanizing of a steel sheet is performed, and then is cooled to 250° C. or less at a cooling rate of 5° C./s or more. Furthermore, a producing method (for example, the Patent Citation 5) for a galvannealed steel sheet, which determines a temperature pattern added up the values obtained by multiplying the heating temperature (T) by the heating time (t) at various times during heating and cooling of the steel sheet during the alloying treatment which results in a galvannealed steel sheet having both good sliding property and powdering resistance, is proposed.

The object of all conventional techniques is that by controlling the alloying degree, a galvannealed layer becomes hard and improves both powdering resistance and flaking resistance so as to reduce the disadvantages in press-forming of the galvannealed steel sheet.

Since sliding property is greatly influenced by a flat portion of surfaces, a producing method (for example, the Patent Citation 6) for a galvannealed steel sheet which has good powdering resistance and sliding property by controlling the flat portion in case of a galvannealed layer containing a large quantity of ζ phase in the surface layer is proposed.

The technique is a method for producing a galvannealed steel sheet which has a galvannealed layer containing a large quantity of ζ phase in the surface layer, good powdering resistance and sliding property by decreasing the alloying degree. However, it is considered that the galvannealed steel sheet is required to further improve flaking resistance (sliding property).

As a method for improving press formability of zinc alloy galvanized steel sheet, a method of applying a lubrication oil of high viscosity is widely used. However, there is a problem in that painting defects are formed in a painting process by insufficient removal of the lubrication oil since the lubrication oil has high viscosity, and a lack of oil in press-forming leads to unstable press performance. Therefore, a method (for example, the Patent Citation 7) of forming an oxide coat containing ZnO mainly on the surface of a zinc alloy galvanized steel sheet and a method (for example, the Patent Citation 8) of forming an oxide coat of Ni oxide is proposed. However, there is a problem in that the oxide films have bad chemical conversion treatability. Therefore, a method (for example, the Patent Citation 9) of forming an Mn based oxide film as a film for improvement of chemical conversion treatability is proposed. However, in all of the techniques of forming the oxide type film, the relationship between the oxide type films and a galvannealed layer has not been specifically investigated.

[Patent Citation 1] Japanese Unexamined Patent Application, First Publication No. 2004-169160

[Patent Citation 2] Japanese Unexamined Patent Application, First Publication No. H6-88187

[Patent Citation 3] Japanese Unexamined Patent Application, First Publication No. H9-165662

[Patent Citation 4] Japanese Unexamined Patent Application, First Publication No. 2007-131910

[Patent Citation 5] Japanese Unexamined Patent Application, First Publication No. 2005-54199

[Patent Citation 6] Japanese Unexamined Patent Application, First Publication No. 2005-48198

[Patent Citation 7] Japanese Unexamined Patent Application, First Publication No. S53-60332

[Patent Citation 8] Japanese Unexamined Patent Application, First Publication No. H3-191093

[Patent Citation 9] Japanese Unexamined Patent Application, First Publication No. H3-249182

SUMMARY OF THE INVENTION

As described above, a galvannealed steel sheet requires good chemical conversion treatability (corrosion resistance). The galvannealed steel sheet also requires good surface quality of appearance and both good powdering resistance and good sliding property in press-forming.

The present invention is contrived in view of the above-described circumstance and an object of the present invention is to provide a galvannealed steel sheet having both good sliding property (flaking resistance) and powdering resistance in press-forming, good surface quality of appearance without uneven appearance by a linear defect, and excellent chemical conversion treatability, and a producing method therefor. In particular, an object of the present invention is to provide a galvannealed steel sheet to increase excellent powdering resistance by low-alloying treatment at a lower heating rate which further increases excellent sliding property, excellent surface quality of appearance, and an excellent chemical conversion treatability, and a producing method therefor.

Poor quality, derived from uneven appearance formed in an alloying treatment for forming a galvannealed layer, which is attributed to a linear defect which is formed by differences in the thickness of a galvannealed layer. The linear defect appears because portions where alloying proceeds rapidly during formation of an alloyed layer grows thicker than other portions. The inventors found that an appearance of a linear defect can be suppressed by alloying a galvanizing layer at a lower heating rate and thereby a galvannealed steel sheet of excellent quality of appearance is obtained as a result of repeated examinations for a forming mechanism of the difference in thickness of a galvannealed layer.

High-alloying treatment of a galvanizing layer forms greater Γ phase. Therefore, a sliding property in press-forming (flaking resistance) is increased, and powdering resistance is decreased. A low-alloying treatment of a galvanizing layer forms less Γ phase and greater ζ phase. Therefore, powdering resistance in press-forming is increased, and a sliding property (flaking resistance) is decreased. Formation of Γ phase cannot be prevented in a galvannealed steel sheet. The inventors repeated examinations for an improving method of a poor sliding property of a galvannealed steel sheet of a low alloying degree having good powdering resistance. As a result, the inventors found that a poor sliding property of a galvannealed steel sheet of a low alloying degree is improved significantly by forming a Mn—P based oxide film on the surface of the galvannealed steel sheet and thereby both powdering resistance and flaking resistance are imparted.

The present invention is accomplished on the basis of the findings and the gist of the present invention is the following.

(1) A galvannealed steel sheet includes: a steel sheet; galvannealed layer; and a Mn—P based oxide film. The steel sheet includes C, Si, Mn, P, Al, and balance composed of Fe and inevitable impurities. A Zn—Fe alloy phase in the galvannealed layer is measured by X-ray diffractometry. The value of a diffraction intensity Γ(2.59 Å) corresponding to an interplanar spacing of d=2.59 Å of Γ phase divided by a diffraction intensity $\delta_1$(2.13 Å) corresponding to an interplanar spacing of d=2.13 Å of $\delta_1$ phase is less than or equal to 0.1. The diffraction intensity ζ(1.26 Å) corresponding to an interplanar spacing of d=1.26 Å of ζ phase divided by a diffraction intensity $\delta_1$(2.13 Å) corresponding to an interplanar spacing of d=2.13 Å of $\delta_1$ phase is greater than or equal to 0.1 and less than or equal to 0.4. The Mn—P based oxide film is formed using 5 to 100 mg/m$^2$ of Mn and 3 to 500 mg/m$^2$ of P on a surface of the galvannealed layer.

(2) The galvannealed steel sheet described in the above (1), wherein the steel sheet includes the following component: 0.0001 to 0.3 mass % of C, 0.01 to 4 mass % of Si; 0.01 to 2 mass % of Mn; 0.002 to 0.2 mass % of P; and 0.0001 to 4 mass % of Al.

(3) The galvannealed steel sheet described in the above (1), wherein the galvannealed layer is measured by X-ray diffractometry of Zn—Fe alloy phase, in which the diffraction intensity Γ(2.59 Å) corresponding to the interplanar spacing of d=2.59 Å of the Γ phase is less than or equal to 100 cps and the diffraction intensity ζ(1.26 Å) corresponding to the interplanar spacing of d=1.26 Å of the ζ phase is greater than or equal to 100 cps and less than or equal to 300 cps.

(4) The galvannealed steel sheet described in the above (1), wherein an amount of Fe in the Zn—Fe alloy phase of the galvannealed layer is greater than or equal to 9.0 and less than or equal to 10.5 mass %.

(5) A method for producing a galvannealed steel sheet, the method includes: performing hot dip galvanization of a steel sheet; forming a galvannealed layer using an alloying treatment of heating in a heating furnace followed by slow cooling in a soaking furnace after a temperature of the steel sheet reaches the maximum reachable temperature at the exit of the heating furnace; and forming a Mn—P based oxide film including Mn and P on a surface of the galvannealed layer. In the alloying treatment, a temperature integration value S is calculated by $S=(T11-T0)\times t1/2+((T11-T0)+(T12-T0))\times t2/2+((T12-T0)+(T21-T0))\times \Delta t/2+((T21-T0)+(T22-T0))\times t3/2+(T22-T0)\times t4/2$, and S satisfies the formula $850+Z \leqq S \leqq 1350+Z$, using a composition dependent coefficient Z represented by $Z=1300\times(\%\ Si-0.03)+1000\times(\%\ Mn-0.15)+35000\times(\%\ P-0.01)+1000\times(\%\ C-0.003)$. Herein, T0 is 420° C., T11(° C.) is the temperature of the steel sheet at the exit of the heating furnace, T12(° C.) is the temperature of the steel sheet at the entry of the cooling zone in the soaking furnace, T21(° C.) is the temperature of the steel sheet at the exit of the cooling zone in the soaking furnace, T22(° C.) is the temperature of the steel sheet at the exit of the soaking furnace, t1(s) is the treating time from an initial position of T0 to the exit of the heating furnace, t2(s) is the treating time from the exit of the heating furnace to the entry of the cooling zone in the soaking furnace, Δt(s) is the treating time from the entry of the cooling zone to the exit of the cooling zone in the soaking furnace, t3(s) is the treating time from the exit of the cooling zone in the soaking furnace to the exit of the soaking furnace, and t4(s) is the treating time from the entry of the quenching zone to a final position of T0. Herein, % Si, % Mn, % P, and % C are the amounts (by mass %) of the respective elements in steel. The Mn—P based oxide film is formed using 5 to 100 $mg/m^2$ of Mn and 3 to 500 $mg/m^2$ of P on the surface of the galvannealed layer.

(6) The method for the galvannealed steel sheet described in the above (5), wherein in the heating furnace for heating of the steel sheet, a heating rate V calculated by $V=(T11-T0)/t1$ is controlled under a condition of a low heating rate of less than or equal to 100° C./s, if the Z is less than 700, and is controlled under a condition of a low heating rate of less than or equal to 60° C./s, if the Z is greater than or equal to 700.

(7) The method for the galvannealed steel sheet according to claim 5, wherein the steel sheet includes 0.0001 to 0.3 mass % of C, 0.01 to 4 mass % of Si; 0.01 to 2 mass % of Mn; 0.002 to 0.2 mass % of P; and 0.0001 to 4 mass % of Al.

According to the present invention, a galvannealed steel sheet which has excellent uniformity of appearance, both good powdering resistance and sliding property (flaking resistance) in press-forming, excellent chemical conversion treatability, and excellent spot weldability is produced.

DETAILED DESCRIPTION OF THE INVENTION

Hereinafter, the present invention will be described in detail.

The reason each element in a steel sheet of a base material in the present invention is limited is described hereinafter. % hereinafter is mass %.

(0.0001 to 0.3% of C)

C is an element required for ensuring strength, and 0.0001% or more of C is required for ensuring the strength. However, 0.3% or more of C makes both alloying and ensuring of weldability difficult. Therefore, the C content is required to be 0.3% or less. It is preferable that the C content be from 0.001 to 0.2%.

(0.01 to 4% of Si)

Si is an element required for ensuring ductility and strength of a steel sheet, and 0.01% or more of Si is required for ensuring the ductility and strength of a steel sheet. However, Si causes an alloying rate to decrease, and thereby the alloying treatment time increases. Therefore, the Si content is required to be 4% or less in order to decrease the alloying treatment at a slow heating rate. It is preferable that the Si content be 0.01 to 1%.

(0.01 to 2% of Mn)

Mn is an effective element for improving the strength of a steel sheet, and 0.01% or more of Mn is required for improving the strength of a steel sheet. However, more than 2% of Mn causes a negative effect on elongation of a steel sheet.

Therefore, the Mn content is required to be 2% or less. It is preferable that the Mn content be 0.4 to 1.5%.

(0.002 to 0.2% of P)

P is an effective element for improving the strength of a steel sheet, and 0.002% or more of P is required for improving the strength of a steel sheet. However, P causes the alloying rate to decrease like Si, and thereby alloying treatment time increases. Therefore, the P content is required to be 0.2% or less in order to decrease alloying treatment time at a slow heating rate.

(0.0001 to 4% of Al)

0.0001% or more of Al is required from a cost standpoint. However, more than 4% of Al causes the alloying rate to decrease. Therefore, the Al content is required to be 4% or less. It is preferable that the Al content be 0.001 to 2%.

A description will be given of a forming mechanism of the difference in thickness of a galvannealing layer causing an uneven appearance of a galvannealed layer.

Figure 1A:
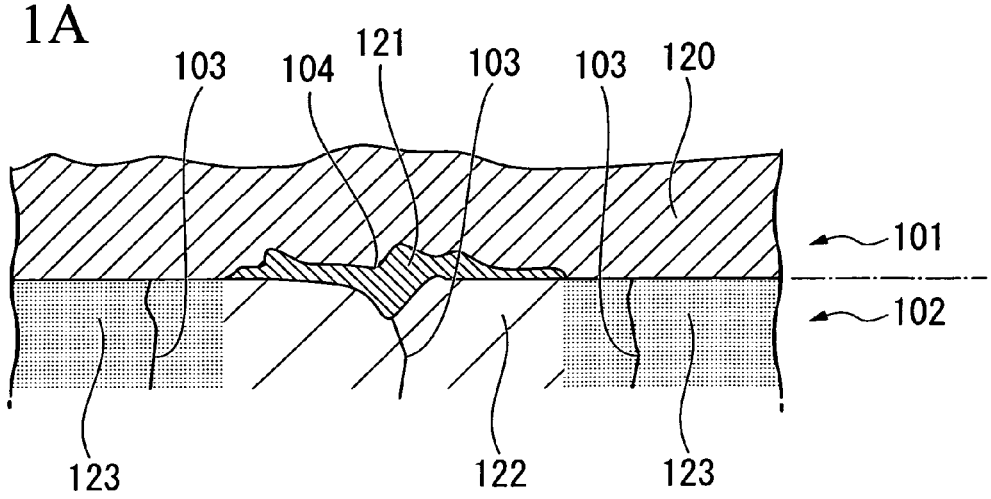
FIG. 1A is a schematic view showing initiation points where a Zn—Fe alloy (a galvannealed layer) is generated in a hot dip galvanizing layer.
Figure 1B:
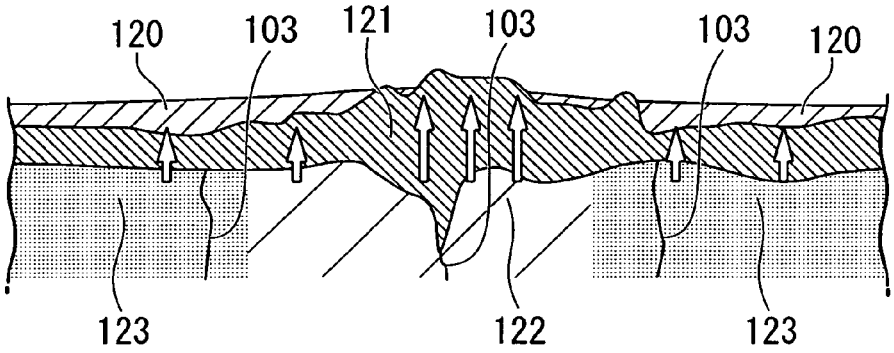
FIG. 1B is a schematic view showing a growth process and a growth rate of a Zn—Fe alloy (a galvannealed layer).
Figure 1C:
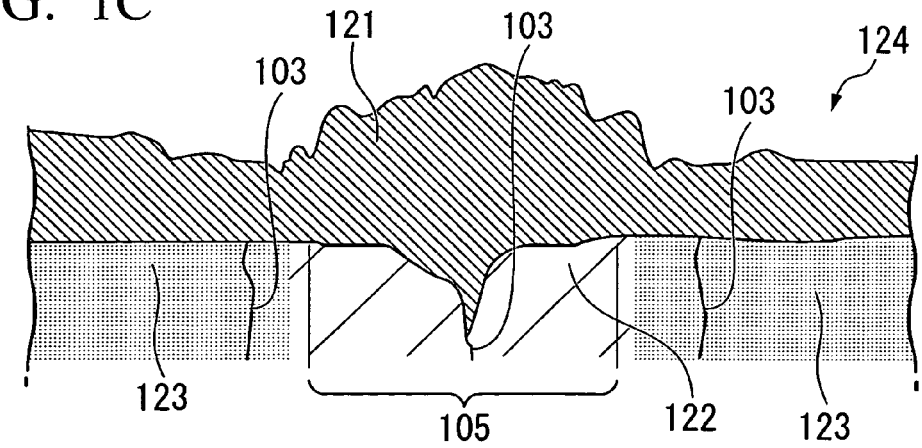
FIG. 1C is a schematic view showing a defect (differences in the thickness of a galvannealed layer) of a galvannealed layer.

FIGS. 1A to 1C are schematic drawings for showing a forming process of a defect (a difference in thickness of a galvannealing layer) of a galvannealed layer.

As shown in FIG. 1A, in alloying of a galvanizing layer 101, an alloying (Fe+Zn reaction) initiation 104 is occurred from a grain boundary 103 located in a P unconcentrated portion of a underneath steel (steel sheet) 102 by an alloying treatment (heating). Fe in the steel sheet 102 and Zn in a hot dip galvanizing layer 120 are interdiffused by the alloying initiation 104, and a galvannealed layer 121 is formed. However, a difference in the alloying rate occurs due to the unevenness of the surface of the steel sheet, that is, the P unconcentrated portion 122 and a P concentrated portion 123. As shown in FIG. 1B, due to the difference of alloying rate, a portion of a galvannealed layer in which the alloying rate is high grows thicker (expressed by arrows) than a peripheral portion of the portion. Therefore, as shown in FIG. 1C, a thick grown portion of a galvannealed steel sheet 124 protrudes, and thereby forms a defect in a portion 105 of a linear defect.

Accordingly, the defect appears due to the difference in thickness of a galvannealed layer caused by differences in the alloying rate.

Figure 2:
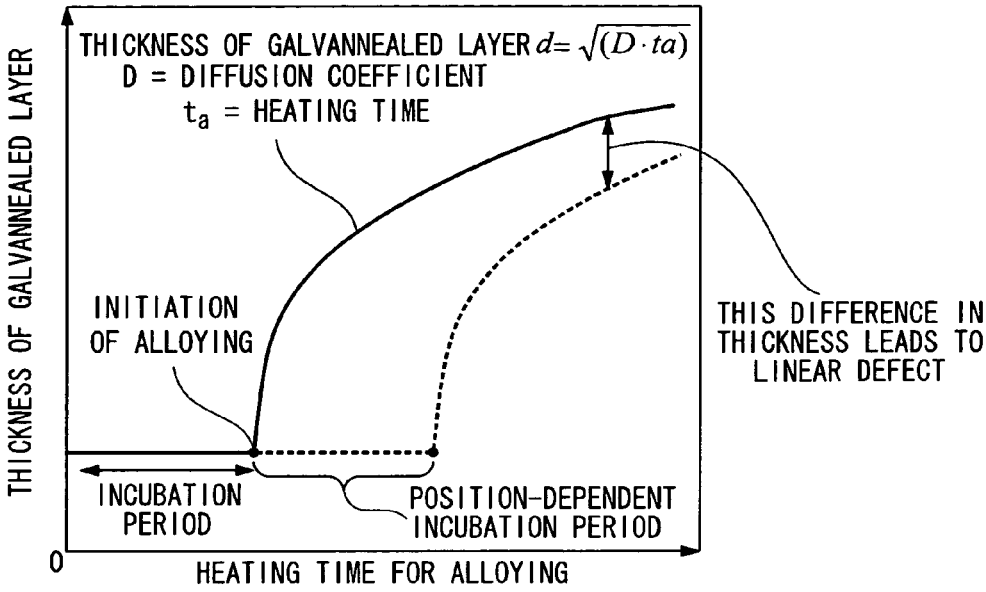
FIG. 2 is a schematic diagram showing a formation mechanism of defects (differences in the thickness of a galvannealed layer) of a galvannealed layer and the relationship between heating time in an alloying treatment and thickness of a galvannealed layer.

FIG. 2 is a schematic diagram for showing a formation mechanism of defects (differences in the thickness of a galvannealed layer) of a galvannealed layer.

An alloying rate (differences in the thickness of a galvannealed layer) d depends on a diffusion coefficient D and heating time $t_a$, and can be expressed in the following Formula (1).

$$d=\sqrt{(D\cdot t_a)} \quad (1)$$

The relationship between differences in thickness of a galvannealed layer d and heating time $t_o$ expressed in the above Formula (1) is shown in FIG. 2. During heating for alloying, alloying is initiated after an incubation period which varies depending on the components in the steel sheet, the crystal orientation, the grain size, and the diffusion coefficient, and then a galvannealed layer is grown. However, differences in incubation periods occur which leads to different alloying initiation times for different parts of the steel sheet. The difference in thickness of a galvannealed layer is formed by differences in incubation periods, and leads to linear defects.

The difference in thickness of a galvannealed layer is influenced by the heating rate.

Figure 3:
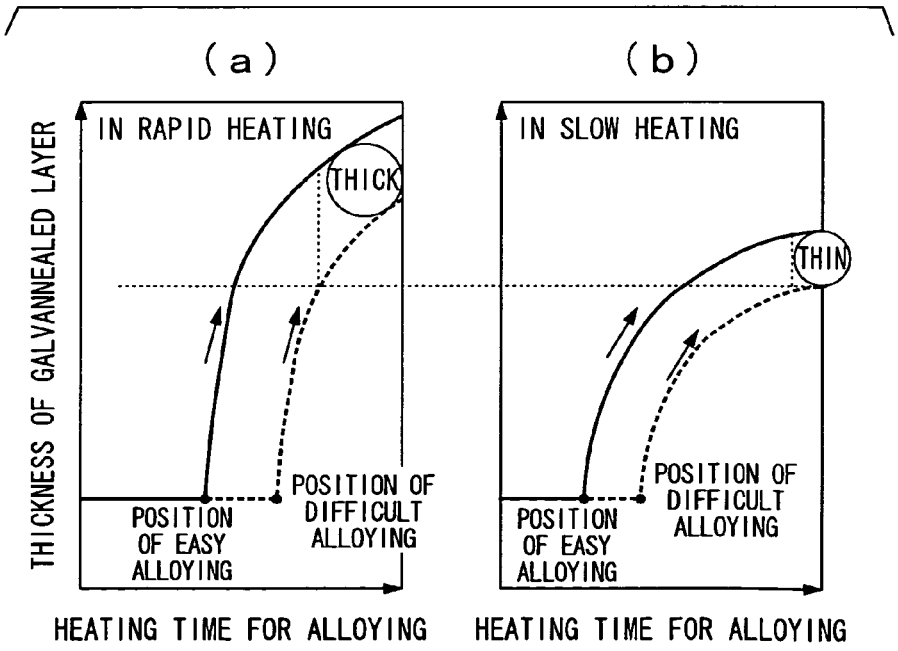
FIG. 3 is a schematic diagram showing that the thickness of a galvannealed layer varies with the heating rate. (a) is a schematic diagram showing the difference in thickness of a galvannealed layer formed at a high heating rate. (b) is a schematic diagram showing the difference in thickness of a galvannealed layer formed at a high heating rate.

FIG. 3 is a schematic diagram for showing that the thickness of a galvannealed layer depends on a heating rate. In particular, (a) in FIG. 3 is a schematic diagram which shows the difference in thickness of a galvannealed layer formed at a rapid heating rate. (b) in FIG. 3 is a schematic diagram which shows the difference in thickness of a galvannealed layer formed at a slow heating rate.

As shown in FIG. 3(*a*), if an alloying treatment is performed by rapid heating, a galvannealed layer grows rapidly. As a result, differences in the thickness of a galvannealed layer caused by differences in the incubation period increase. However, as shown in FIG. 3(*b*), if an alloying treatment is performed by slow heating, a galvannealed layer grows slowly. As a result, differences in the thickness of a galvannealed layer caused by differences in incubation periods decrease. Therefore, an appearance of a defect can be suppressed, and a galvannealed layer having excellent quality of appearance can be formed.

As described above, it was found that the alloying degree (the thickness of the galvannealed layer) depended on the incubation period and the diffusion coefficient. In addition, it was found that the great differences in the thickness of a galvannealed layer occurred and the linear defect became noticeable in the case of a greater difference in the incubation periods or in the case of higher heating rate.

The differences in incubation periods vary with the components of a steel sheet. Therefore, if many elements which are easily segregated in grain boundaries are contained and the rate of the interdiffusion of Fe and Zn changes with location, the differences in the thickness of a galvannealed layer occur. Furthermore, the rate of the interdiffusion of Fe and Zn varies with an additive amount of the elements. Accordingly, it is required that a condition of the heating rate V for an alloying treatment is determined depending on the additive amount of the elements.

Therefore, in the present invention, the heating rate for the alloying treatment is controlled under a condition of the lower heating rate, and thereby the appearance of a linear defect is suppressed. Specifically, the alloying treatment is performed under the following conditions. A temperature integration value S calculated by the Formula (6), which is described in the following in detail, satisfies the following Formula (8), that is $850+Z \leqq S \leqq 1350+Z$, using a composition dependent coefficient Z calculated by the following Formula (7). In addition, the heating rate V calculated by the following Formula (9) may be controlled under a condition of a low heating rate of less than 100° C./s if the composition dependent coefficient Z is less than 700, and may be controlled under a condition of a low heating rate of less than 60° C./s if the composition dependent coefficient Z is greater than or equal to 700.

Press formability is described below.

In the production process of the galvannealed steel sheet, a steel sheet annealed in an annealing furnace is dipped into a hot galvanizing bath (pot) to be galvanized on the steel sheet, and thereby a hot dip galvanized steel sheet is produced. The hot dip galvanized steel sheet is heated to a maximum reachable temperature in a heating furnace, is cooled slowly in a soaking furnace, and then is cooled rapidly in a rapid cooling zone, thereby producing a galvannealed steel sheet. The alloying degree is determined by the alloying temperature in the alloying treatment.

Figure 4:
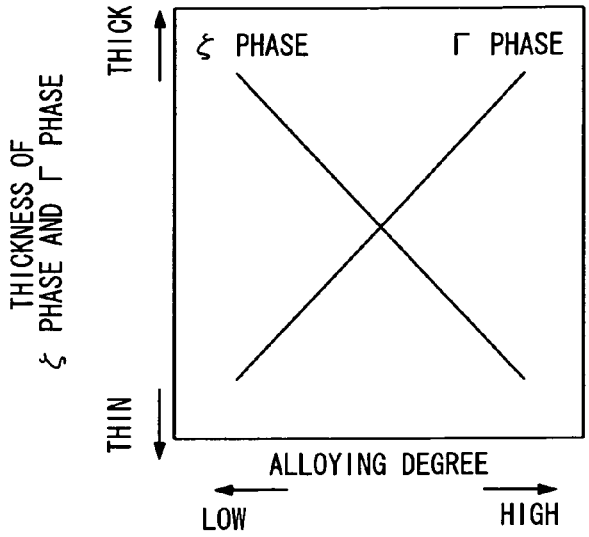
FIG. 4 is a schematic diagram showing the relationship between thickness of Γ phase and an alloying degree of a galvannealed layer and the relationship between thickness of ζ phase and an alloying degree of a galvannealed layer.

FIG. 4 shows the relationship between the thickness of formed Γ phase and an alloying degree and the relationship between the thickness of formed ζ phase and an alloying degree. As shown in FIG. 4, a low alloying degree promotes the formation of ζ phase and suppresses the formation of Γ phase. Therefore, thickness of ζ phase is increased, and thickness of Γ phase is decreased. A high alloying degree promotes the formation of Γ phase, and suppresses the formation of phase. Therefore, the thickness of Γ phase is increased, and the thickness of ζ phase is decreased.

Since thick Γ phase is formed in an interface between the steel sheet and the galvannealed layer by the growth of Γ phase in the case of a high alloying degree, powdering occurs on the galvannealed steel sheet in press-forming. If the alloying degree is high and the Fe concentration is 10.5% or more, Γ phase grows thicker and powdering occurs. If the alloying degree is low, ζ phase on the surface of the galvannealed layer increases and flaking occurs in press-forming. In addition, since weldability deteriorates when there is a low Fe concentration, a production process of vehicles is adversely influenced.

Figure 5:
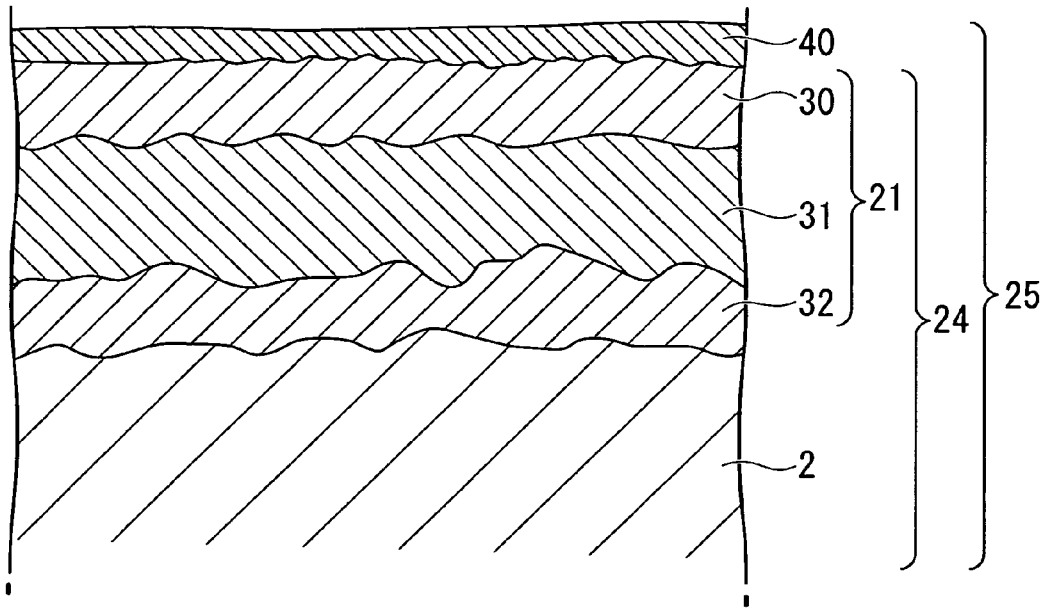
FIG. 5 is a schematic view showing a structure of a galvannealed steel sheet of the present invention.

In the present invention, an occurrence of powdering can be suppressed by decreasing the alloying degree, that is, by suppressing the formation of Γ phase and promoting the formation of ζ phase. In addition, a method for suppressing flaking caused by a decreased the alloying degree is investigated. As a result, as shown in FIG. 5, it is found that a Mn—P based oxide film 40 is formed on the surface of a low-galvannealed steel sheet 24, a galvannealed steel sheet 25 treated by the oxide film is produced, and thereby the sliding property on the surface of the steel sheet can be improved significantly and occurrences of flaking can be prevented. As shown in FIG. 5, the galvannealed steel sheet 25 includes a steel sheet 2, a Mn—P based oxide film 40, and a galvannealed layer 21 which has, ζ phase 30, $\delta_1$ phase 31, and Γ phase 32. The galvannealed steel sheet 25 in the present invention includes a galvannealed steel sheet 24 and a Mn—P based oxide film 40.

Figure 6:
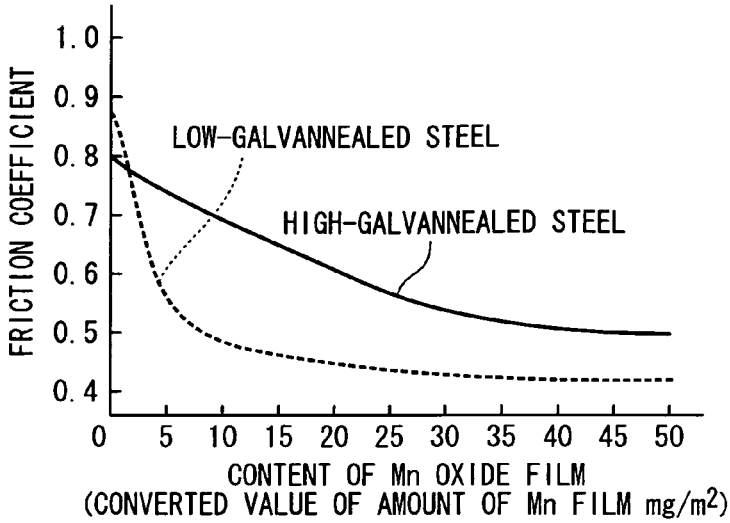
FIG. 6 is a diagram showing a relationship between the content of a coated film and the friction coefficient when a Mn—P based oxide film is formed on the surface of galvannealed steel sheets having various alloying degrees.

FIG. 6 shows the relationship between the content of a coated film and the friction coefficient when a Mn—P based oxide film is formed on the surface of a galvannealed steel sheets having various alloying degrees.

A cold-rolled steel sheet of an IF steel material and a cold-rolled steel sheet of a high strength steel material were galvanized in a hot galvanizing bath, and were alloyed under the various alloying conditions so as to vary the heating rate. As a result of the alloying treatment, a low-galvannealed steel sheet and a high-galvannealed steel sheet were prepared. Mn—P based oxide films were formed on the respective galvannealed steel sheets as lubricative films, and the respective friction coefficients were investigated.

As a friction coefficient for press-forming, a pulling load is measured by tests applying surface pressure of 100 to 600 kgf under the following conditions: sample size is 17 mm×300 mm, pulling speed is 500 mm/min, the square beat shoulder R is 1.0/3.0 mm, the sliding length is 200 mm, the lubrication is NOX-RUST 530E-40 (PARKER INDUSTRY, INC.), and the amount of lubricant is 1 g/m$^2$. Friction coefficients were obtained from slopes of a pulling load to surface pressure.

As shown in FIG. 6, a low-galvannealed steel sheet (mainly, $\delta_1$+ζ phase) has a higher friction coefficient and a poorer sliding property than a high-galvannealed steel sheet. However, if a Mn—P based oxide film is formed on the respective surfaces, the friction coefficient of the low-galvannealed steel sheet decreases significantly in the case of a low amount of the Mn—P based oxide film, as compared with the friction coefficient of the high-galvannealed steel sheet. Accordingly, if the alloying degree is decreased and the ζ phase is increased, a sliding property can be improved regardless of the lower amount of a Mn—P based oxide film. In addition, in the case of a pre-determined amount of a Mn—P based oxide film, the low-galvannealed steel sheet has a better sliding property than the high-galvannealed steel sheet. It is considered that the better sliding property is developed by a low Fe concentration in a galvannealed layer of the low-galvannealed steel sheet. However, it is not clear what the mechanism of the improvement of the sliding property is in detail.

In the present invention, the formation of Γ phase is suppressed and the formation of ζ phase is promoted by decreasing the alloying degree, and thereby occurrences of powdering can be suppressed. Moreover, an occurrence of problematic flaking can be suppressed by forming a Mn—P based oxide film as an inorganic based lubricative film.

The alloying degree of the galvannealed steel sheet is determined by the alloying temperature, the heating time, the cooling condition, and the like. The low-galvannealed steel sheet having a large quantity of ζ phase can be typically obtained under the following conditions for heating treatment. A steel sheet is galvanized in a hot galvanizing bath, and then is heated at a heating rate of 40 to 70° C./s to 500 to 670° C. in an induction heating furnace. The galvannealed steel sheet is held for 5 to 20 seconds at the alloying temperature of 440 to 530° C., and is controlled to be an Fe concentration of 6.5 to 13% in a Zn—Fe alloy. It is preferable that the Fe concentration in the Zn—Fe alloy be 9.0 to 10.5%.

Since the alloying degree becomes sufficient and the weldability deteriorates, it is not preferable that the Fe concentration be less than 9.0%. Since the Γ phase is increased and the powdering resistance deteriorates, it is not preferable that the Fe concentration be greater than 10.5%.

The diffraction intensities of the Γ phase, the $\delta_1$ phase, and the ζ phase of the Zn—Fe alloy in the low-galvannealed steel sheet were investigated by X-ray diffractometry. As a result, the following findings were derived. That is, it is important that the phase structure of the galvannealed layer in the present invention be controlled so that respective diffraction intensities of the Γ phase, the $\delta_1$ phase, and the ζ phase satisfy the following Formulae (2) and (3).

$$\Gamma(2.59\ \text{Å})/\delta_1(2.13\ \text{Å}) \leqq 0.1 \quad (2)$$

$$0.1 \leqq \zeta(1.26\ \text{Å})/\delta_1(2.13\ \text{Å}) \leqq 0.4 \quad (3)$$

According to the above Formula (2), it is required that Γ(2.59 Å)/$\delta_1$(2.13 Å) be equal to 0.1 or less. If Γ(2.59 Å)/$\delta_1$(2.13 Å) is greater than 0.1, the powdering resistance of the galvannealed steel sheet deteriorates in press-forming due to increasing of the hard and brittle Γ phase in the interface between the galvannealed layer and the steel sheet. According to the above Formula (3), it is required that ζ(1.26 Å)/$\delta_1$(2.13 Å) be 0.1 or more, and 0.4 or less. If ζ(1.26 Å)/$\delta_1$(2.13 Å) is less than 0.1, the ζ phase is decreased. Therefore, the improving effect of sliding property beyond the conventional materials is not obtained when Mn—P based oxide film is formed. If ζ(1.26 Å)/$\delta_1$(2.13 Å) is greater than 0.4, the amount of unalloyed Zn is increased and the weldability deteriorates.

Moreover, in a phase structure of a galvannealed layer of the present invention, it is preferable that the diffraction intensities of the Γ phase and the ζ phase satisfy the following Formulae (4) and (5), respectively.

$$\Gamma(2.59\ \text{Å}) \leqq 100(\text{cps}) \quad (4)$$

$$100 \leqq \zeta(1.26\ \text{Å}) \leqq 300(\text{cps}) \quad (5)$$

A phase structure of a galvannealed layer is determined by measuring the diffraction intensities of the Γ phase, the $\delta_1$ phase and the ζ phase by X-ray diffractometry. Specifically, after a galvannealed layer is bonded to an iron sheet using an epoxy resin and the epoxy resin is cured, a galvannealed layer with the epoxy resin is separated from a base steel by pulling mechanically. Diffraction peaks of each alloy phase in the separated galvannealed layer are measured from an interface between the galvannealed layer and the base steel by X-ray diffractometry.

Conditions of X-ray diffraction are the following: the measurement area is a precise circle of 15 mm in diameter, diffraction peaks are measured using the θ-2θ method, the X-ray tube is a Cu tube, the X-ray tube voltage is 50 kV, and the X-ray tube current is 250 mA. Under these conditions, the intensities of the diffraction peaks derived from alloy phases are measured and determined to be Γ(2.59 Å), $\delta_1$(2.13 Å), and ζ(1.26 Å). Γ(2.59 Å) (cps) is a diffraction intensity of an interplanar spacing d=2.59 Å derived from Γ phase ($Fe_3Zn_{10}$) and $\Gamma_1$ phase ($Fe_5Zn_{21}$). $\delta_1$ (2.13 Å) (cps) is a diffraction intensity of an interplanar spacing d=2.13 Å derived from $\delta_1$ phase ($FeZn_7$). ζ(1.26 Å) (cps) is a diffraction intensity of an interplanar spacing d=1.26 Å derived from ζ phase ($FeZn_{13}$). Since it is difficult to distinguish between the Γ phase and the $\Gamma_1$ phase crystallographically, the Γ phase in the present invention includes $\Gamma_1$ phase as well as F phase.

As a method for producing a galvannealed steel sheet of a low alloying degree especially desired in the present invention, a temperature pattern is determined for an alloying treatment on the basis of a temperature integration value S, which is calculated by adding up the values obtained by multiplying temperature (T) by time (t) at various times during heating and cooling during the alloying treatment.

In the method for producing a galvannealed steel sheet, a hot dip galvanized steel sheet is heated in a heating furnace, and then is cooled slowly in a soaking furnace after a temperature (T11) of the steel sheet reaches the maximum reachable temperature at the exit of the heating furnace.

A galvannealed steel sheet of a low alloying degree having a phase structure of a predetermined content of Fe is easily produced by the following method. As a condition for the alloying treatment, a temperature integration value S calculated by the known following Formula (6) may satisfy the following Formula (8), that is 850+Z≦S≦1350+Z, using a composition dependent coefficient Z calculated by the following Formula (7).

$$S = (T11 - T0) \times t1/2 + ((T11 - T0) + (T12 - T0)) \times t2/2 + ((T12 - T0) + (T21 - T0)) \times \Delta t/2 + ((T21 - T0) + (T22 - T0)) \times t3/2 + (T22 - T0) \times t4/2 \quad (6)$$

In the above Formula (6), T0 is 420° C., T11(° C.) is the temperature of a steel sheet at the exit of a heating furnace, T12(° C.) is the temperature of the steel sheet at the entry of the cooling zone in the soaking furnace, T21(° C.) is the temperature of the steel sheet at the exit of the cooling zone in the soaking furnace, T22(° C.) is the temperature of the steel sheet at the exit of the soaking furnace, t1(s) is the treating time from an initial position of a temperature T0 to the exit of the heating furnace, t2(s) is the treating time from the exit of the heating furnace to the entry of the cooling zone in the soaking furnace, Δt(s) is the treating time from the entry of the cooling zone to the exit of the cooling zone in the soaking furnace, t3(s) is the treating time from the exit of the cooling zone in the soaking furnace to the exit of the soaking furnace, and t4(s) is the treating time from the entry of the quenching zone to a final position of a temperature of T0.

$$Z = 1300 \times (\%\,Si - 0.03) + 1000 \times (\%\,Mn - 0.15) + 35000 \times (\%\,P - 0.01) + 1000 \times (\%\,C - 0.003) \quad (7)$$

% Si, % Mn, % P, and % C are the amounts (by mass %) of the respective elements in steel.

$$850+Z \leqq S \leqq 1350+Z \quad (8)$$

The condition that the temperature integration value S satisfies the Formula (8) is determined on the basis of the following reasons. In the case of the temperature integration value S of less than 850+Z, the weldability deteriorates since ζ(1.26 Å)/$\delta_1$(2.13 Å) becomes more than 0.4. In the case of the temperature integration value S of more than 1350+Z, the powdering resistance deteriorates since Γ(2.59 Å)/$\delta_1$(2.13 Å) becomes more than 0.1.

Moreover, the appearance is significantly influenced by the heating rate, that is, a heating rate V (° C./s) calculated by the following Formula (9), until the temperature (T11) of the steel sheet at the exit of a heating furnace is reached. Therefore, in the case of a composition dependent coefficient Z of less than 700, a heating rate V calculated by the Formula (9) may be limited to 100° C./s or less. In the case of a composition dependent coefficient Z of 700 or more, a heating rate V may be limited to 60° C./s or less. Controlling the heating rate V allows production of a galvannealed steel sheet having a good quality of appearance. The lower limit of V is not especially limited. However, V is determined to be 30° C./s or more in order to maintain S at a predetermined value.

$$V=(T11-T0)/t1 \quad (9)$$

The above Formula (9), T0 is 420° C., T11(° C.) is the temperature of a steel sheet at the exit of a heating furnace, and t1(s) is the treating time from an initial position of a temperature T0 to the exit of the heating furnace.

Figure 7:
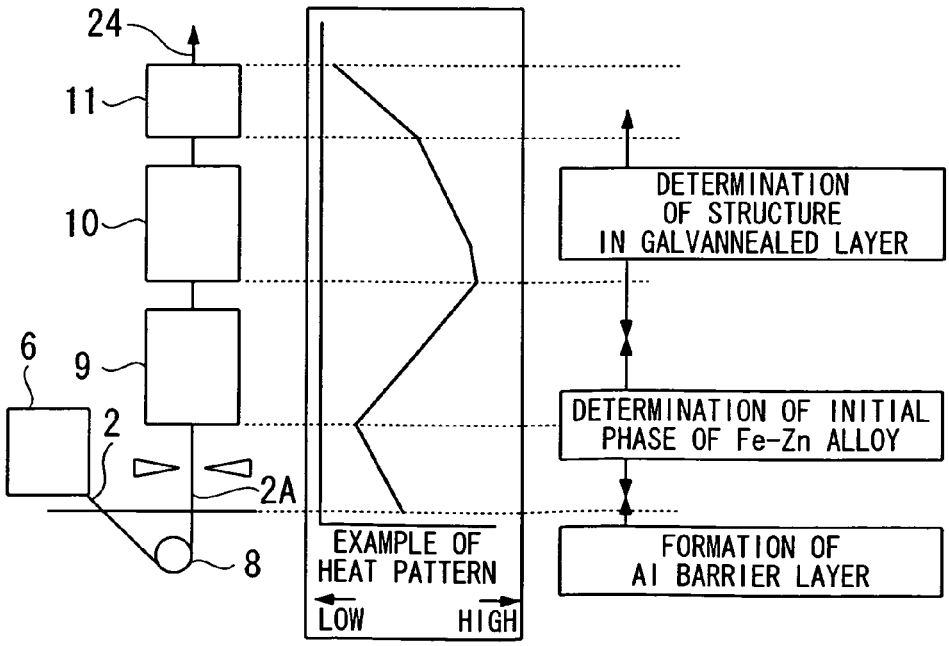
FIG. 7 is a diagram showing an example of a production process of a galvannealed steel sheet in the present invention.

A production process of a galvannealed steel sheet in the present invention is shown as an example in FIG. 7.

A steel sheet 2 annealed in an annealing furnace 6 is galvanized on the surface of the steel sheet 2 by a dip in a hot galvanizing bath (pot) 8. A hot dip galvanized steel sheet 2A is heated to a maximum reachable temperature in a heating furnace 9, is cooled slowly in a soaking furnace 10, and then is cooled rapidly in a rapid cooling zone 11, a galvannealed steel sheet 24 being produced thereby. A forced cooling may be performed for a predetermined amount of time in the soaking furnace 10. An example of a heat pattern in the production process of a galvannealed steel sheet is shown on the right-hand side of FIG. 7. A steel sheet 2 is dipped in a hot galvanizing bath (pot) 8. An Fe—Al alloy phase (Al barrier layer) is generated at first during dipping of the steel sheet 2, and the alloy phase forms a barrier against an alloying reaction between Fe and Zn. A hot dip galvanized steel sheet 2A taken out of the hot galvanizing bath (pot) 8 is heated to a maximum reachable temperature in a heating furnace 9 after being cooled during a process for controlling an amount of a hot dip galvanizing layer. An initial phase of an Fe—Zn alloy is determined in the heating process. A structure in a galvannealed layer is determined by diffusion of Fe and Zn in a cooling process in a soaking furnace 10.

Figure 8:
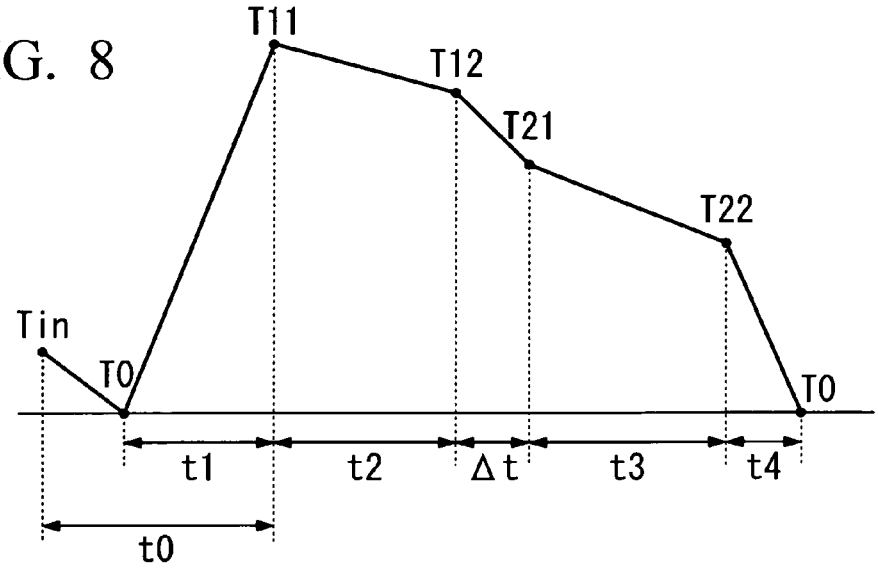
FIG. 8 is a diagram showing an example of a heat pattern of a galvannealed steel sheet of the present invention.

An example of an embodiment of a heat pattern of a galvannealed steel sheet in the present invention is shown in FIG. 8.

A hot dip galvanized steel sheet (a temperature T0) galvanized by dipping a steel sheet of a temperature (Tin) in a hot galvanized bath is heated to a temperature (T11) of the steel sheet in a heating furnace. The hot dip galvanized steel sheet is cooled slowly in a soaking furnace divided into two furnaces. The hot dip galvanized steel sheet is fed into the first soaking furnace at a temperature T12 after being taken out of the heating furnace, and then is cooled from a temperature T12 to a temperature T21 in a cooling system (a cooling zone). The cooling process may be skipped.

The hot dip galvanized steel sheet is cooled to a temperature T0 in a rapid cooling zone after cooled slowly to a temperature T22 in the second soaking furnace.

As a result of investigations of the relationship between a temperature integration value S in the present invention and a structure of a galvannealed layer, the inventors found that the temperature integration value S satisfies the Formulae (7) and (8), that is $Z=1300\times(\%\ Si-0.03)+1000\times(\%\ Mn-0.15)+35000\times(\%\ P-0.01)+1000\times(\%\ C-0.003)$ and $850+Z\leqq S\leqq 1350+Z$, a heat pattern is regulated under conditions where a heating rate V calculated by the Formula (9) is limited to 100° C./s or less in the case of a composition dependent coefficient Z of less than 700 and a heating rate V is limited to 60° C./s or less in the case of a composition dependent coefficient Z of 700 or more, and thereby the galvannealed layer can substantially become a structure including a ζ phase having required product properties and excellent quality of appearance.

In the embodiment, the temperature integration value S is calculated from the Fe concentration, the above t1 to t4 is determined from a line speed (LS), and (T11−T12) is determined from conditions of a soaking furnace. T11 and T22 are determined on the basis of the above values and Δt. If a soaking furnace does not have a cooling zone, Δt in the above Formula (6) is zero.

A concept of temperature integration value S in the present invention is described in the following.

A diffusion coefficient D and diffusion distance X in a galvannealed layer can be expressed in the following Formulae (10) and (11), respectively.

$$D=D0\times\exp(-Q/R\cdot T) \tag{10}$$

$$X=\sqrt{(D\cdot t)} \tag{11}$$

Herein, D is the diffusion coefficient, D0 is the constant, Q is the activation energy for diffusion, R is the gas constant, T is the temperature, X is the diffusion distance, and t is time.

The above Formula (10) is approximated by Taylor expansion, and $D\propto(A+B\cdot T)$ is obtained.

The following Formula (12) is obtained by substituting the obtained D for the Formula (11).

$$X\propto\sqrt{(A\cdot t+B\cdot T\cdot t)} \tag{12}$$

As derived from the Formula (12), since a diffusion distance X can represent the Fe concentration in a galvannealed layer, a temperature integration value S added up the values obtained by multiplying a time (t) by a temperature (T) relates to the Fe concentration in the galvannealed layer.

An example of a determination procedure on alloying conditions in the present invention is shown hereinafter.

The determination procedure on the alloying conditions employs the following method. The relationship between the above temperature integration value S and the Fe concentration in a galvannealed layer is calculated. A correlation between an alloying degree and a temperature (T11) of a steel sheet at the exit of a heating furnace, that is T11=f {alloying degree (Fe concentration), steel grade, coating weight, line speed of steel strip, thickness of steel sheet}, is derived from the above relationship and a computational expression for calculating a temperature integration value S. The temperature (T11) of a steel sheet at the exit of a heating furnace is always automatically calculated for optimization, depending on each parameter. An amount of heat input to the heating furnace is controlled in order to keep the calculated optimum temperature of the steel sheet at the exit of the heating furnace.

<Sampling of Data>

(i) The minimum values of temperature integration values S for alloying of a predetermined degree corresponding to each condition (steel grade, coating weight, line speed of steel strip, thickness of steel sheet) is calculated, and then influence coefficients of steel grades corresponding to the optimum temperature of a steel sheet at the exit of a heating furnace is derived.

(ii) The correlation between a temperature integration value S and an Fe concentration (alloying degree) in a galvannealed layer is calculated by varying the temperature of a steel sheet at the exit of a heating furnace, S=f (Fe % in a galvannealed layer) is derived.

Figure 9:
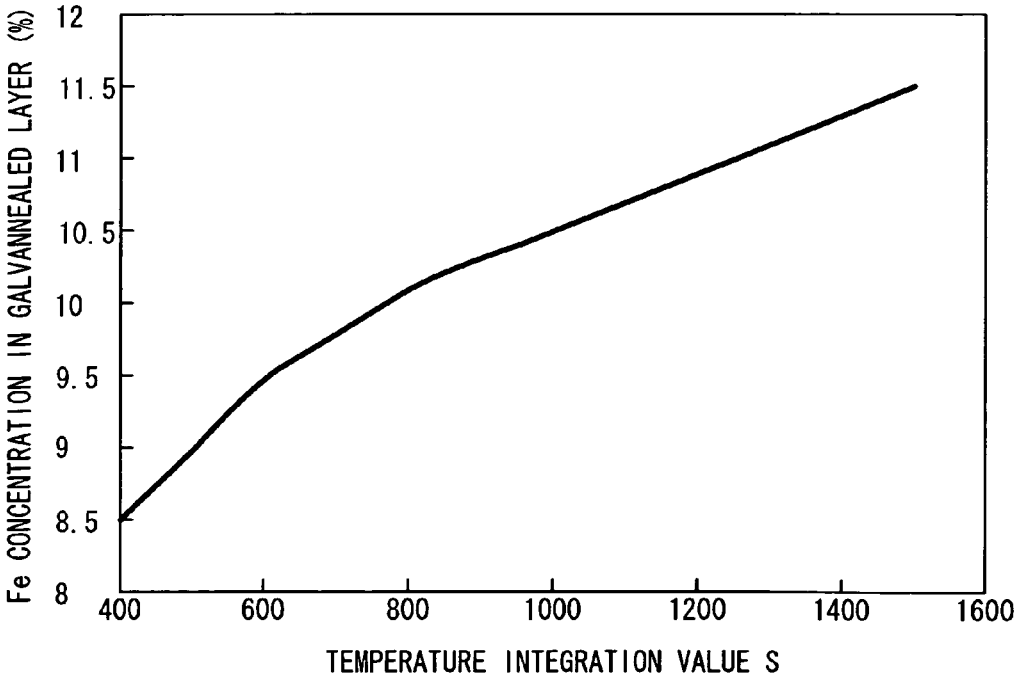
FIG. 9 is a diagram showing an example of the relationship between the temperature integration values (S) of the present invention and the Fe concentration in a galvannealed layer when the amount of elements in a steel sheet are low.

The relationship between an Fe concentration in a galvannealed layer and a temperature integration value S in the present invention under conditions where the amount in mass % is 0.01% of Si, 0.01% of Mn, 0.005% of P, and 0.001% of C in an IF steel sheet is shown as an example in FIG. 9.

Figure 10:
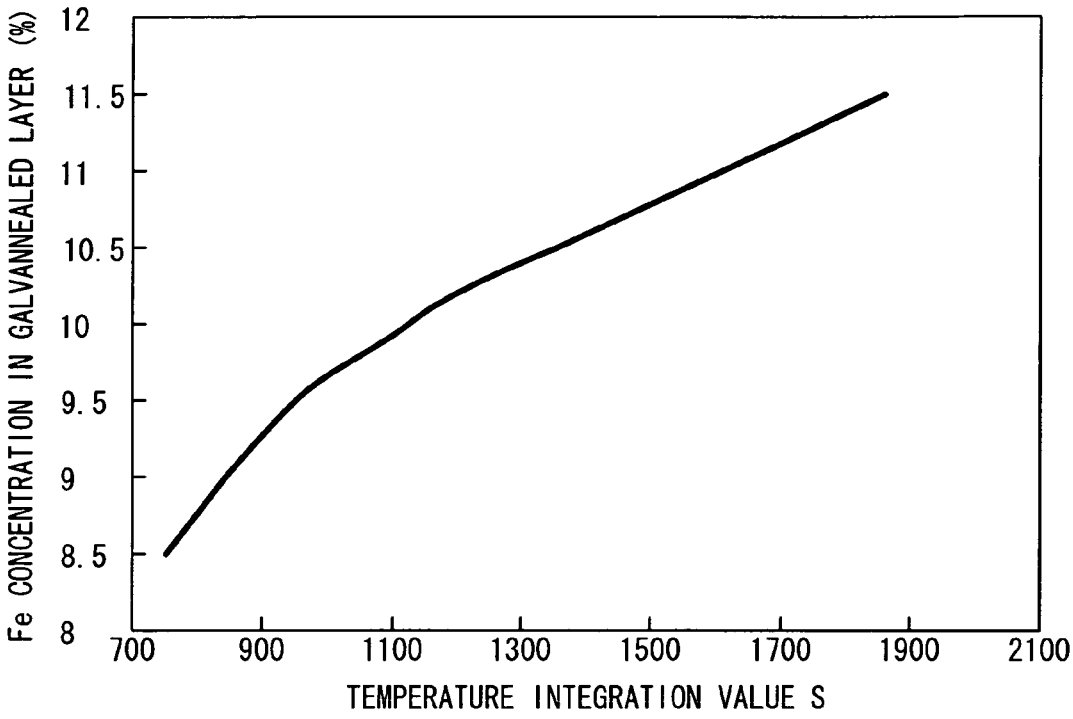
FIG. 10 is a diagram showing an example of the relationship between temperature integration values (S) of the present invention and the Fe concentration in a galvannealed layer.

The relationship between an Fe concentration in a galvannealed layer and a temperature integration value S in the present invention under conditions where the amount in mass % is 0.03% of Si, 0.15% of Mn, 0.02% of P, and 0.003% of C in a high strength steel sheet is shown as an example in FIG. 10.

As shown in FIGS. 9 and 10, the relationship between a temperature integration value S and the Fe concentration in a galvannealed layer varies depending on elements and composition in a steel sheet.

A composition dependent coefficient Z is a coefficient which corrects for the relationship between a temperature integration value S and the Fe concentration in a galvannealed layer in accordance with different elements and compositions in a steel sheet. Accordingly, a value of S may be corrected by adding a composition dependent coefficient Z calculated by the Formula (7) to a value of the above S in accordance with conditions of different elements and composition in a steel sheet.

As above, in FIGS. 9 and 10, there is a correlation between the Fe concentration in a galvannealed layer and a temperature integration value S of an IF steel sheet or high strength steel sheet having a mass per unit area (coating weight) of 40 to 50 mg/m$^2$. Therefore, a simple approximation calculated using the above correlation is represented by the Formula (a).

$$\text{Fe }\%=f(S) \tag{a}$$

Through using the Formula (a), the above temperature integration value S can be determined by the following Formula (b) in accordance with a target Fe concentration.

$$S=f(\text{Fe concentration}) \tag{b}$$

(iii) A prediction formula of a temperature (T22) of a steel sheet at the exit of a soaking furnace is derived from actual data.

The difference between the temperature (T11) of a steel sheet at the exit of a heating furnace and a temperature (T22) of a steel sheet at the exit of a holding temperature calculated by multiple regression analysis on the basis of actual data in FIGS. 9 and 10 is expressed in the Formula (c).

$$T11-T22=f(\text{line speed of a steel strip, thickness of a steel sheet}) \tag{c}$$

A steel sheet is typically cooled by approximately 5 to 30° C. during cooling in a soaking furnace. However, a temperature pattern may be determined by including a decrease in temperature during the cooling of T12−T21 in T11−T22.

<Data Analysis>

(iv) The above Formulae (b) and (c) are substituted into the following Formula (d) which is obtained by substituting actual values in FIGS. 9 and 10 into the above Formula (6) of a definitional formula of a temperature integration value S. In this manner, S=f (temperature of a steel sheet at the exit of heating furnace, line speed of a steel strip, thickness of a steel sheet) is derived, and the Formulae (d) and (e) can be obtained.

$$S=f(\text{line speed of a steel strip}, T11, T22) \quad (d)$$

$$T11=f(\text{line speed of a steel strip, thickness of a steel sheet, Fe concentration}) \quad (e)$$

(v) A correlation between a mass per unit area (coating weight) and Fe concentration is linear. Therefore, the following Formula (f) can be obtained by substituting an Fe concentration+$\alpha\cdot\Delta$ mass per unit area into the Fe concentration of the Formula (b) after an influence coefficient $\alpha$ depending on a coating weight corresponding to a temperature of a steel sheet at the exit of a heating furnace is calculated.

$$T11=f(\text{line speed of a steel strip, thickness of a steel sheet, Fe concentration, coating weight}) \quad (f)$$

In the Formula (f), $\alpha$ is a gradient of the above correlation, $\Delta$ mass per unit area is an increase of a mass per unit area on the basis of a standard value.

(vi) The Formula (g) can be obtained by adding an influence coefficient of a steel grade corresponding to an optimum temperature of a steel sheet at the exit of a heating furnace calculated in (i) into the Formula (f). A value of T11 is determined so that a value of the above V does not exceed a predetermined value (60° C./s or 100° C./s) selected in accordance with a composition dependent coefficient Z.

$$T11=f(\text{line speed of a steel strip, thickness of a steel sheet, Fe concentration, coating weight, steel grade}) \quad (g)$$

The temperature (T11) of a steel sheet at the exit of a heating furnace is determined using the Formula (g) on the basis of the temperature integration value S determined above. Accordingly, an amount of heat input in a heating furnace can be controlled so as to keep a temperature (T11) of a steel sheet at the exit of the heating furnace in accord with the thickness of a steel sheet, a line speed of a steel strip, the mass per unit area, the alloying degree (Fe concentration) and/or the steel grade.

Hereinafter, a control flow is described in the embodiment of the present invention.

The first computer transmits the steel grade, the size of a steel sheet, the upper and lower limits of coating weight and the classification of the alloying degree to the second computer. The second computer calculates the terms except for an influence term of a line speed (LS) of a steel strip using a controlling formula of a temperature of a steel sheet at the exit of an induction heating furnace (IH), and then transmits it to a control unit.

The control unit calculates a temperature of a steel sheet at the exit of the IH including the above influence term of the line speed (LS) of a steel strip, and determines an output electric power of the IH. Moreover, the control unit transmits setting values of temperatures of a steel sheet at the entry and exit of the IH, actual values of the temperatures, an actual value of an electric power and the like to the second computer.

The second computer inspects for an alloying quality using the difference between an actual value of a temperature (T11) of a steel sheet at the exit of the IH and a setting value of a temperature of a steel sheet at the exit of the IH calculated by the second computer. The second computer transmits the setting values of temperatures of a steel sheet at the entry and exit of the IH, the actual values of the temperatures, the actual value of the electric power and the like to the first computer. The first computer automatically suspends a coil of the quality of "not good" inspected by the second computer. The first computer records each actual value in a database.

As described above, a hot dip galvanized steel sheet is heated to a temperature (T11) at the exit of a heating furnace of a maximum reachable temperature, cooling slowly in a soaking furnace, and performing an alloying treatment under conditions that a temperature integration value S calculated by the Formula (6) satisfies the Formula (8), that is $850+Z \leqq S \leqq 1350+Z$, using a composition dependent coefficient Z calculated by the Formula (7), and thereby a galvannealed steel sheet of a low alloying degree in the present invention can be produced efficiently.

A Mn—P based oxide film formed on a galvannealed steel sheet of a low alloying degree is described in the following.

In the present invention, a Mn—P based oxide film is formed as a lubricative hard film on the surface of a steel sheet in order to improve the sliding property of a galvannealed steel sheet of a low alloying degree and prevent flaking in press-forming. As shown in FIG. 6, it is found that the sliding property is significantly improved by forming a small amount of an oxide film.

An aqueous solution including P is mixed in order to improve adhesiveness and film formability of an oxide film. By virtue of the film forming method, film formability and lubricity are improved since a Mn—P based oxide film is formed and a structure of the Mn—P based oxide film becomes homogeneous. Therefore, press formability and chemical conversion treatability are improved. Since a Mn—P based oxide film is a glassy film similar to a chromate film, adhesion of a galvannealed layer to dies in press-forming is suppressed and the sliding property is increased. In addition, since the Mn—P based oxide film can be dissolved in a solution of a chemical conversion treatment, a chemical film can be easily formed on the Mn—P based oxide film unlike a chromate film. Since the Mn—P based oxide film is included in the chemical film as a component, the Mn—P based oxide film does not cause harmful effect by dissolution into a solution of a chemical conversion treatment and has good chemical conversion treatability.

A structure of a Mn—P based oxide film is not clear, and it is considered that the structure is mainly networks made up of Mn—O bond and P—O bond. It is supposed that OH radicals, $CO_2$ radicals and the like in the network are partly included and an amorphous large molecule structure partly substituted by metals supplied from a galvannealed layer is formed.

For example, as a method for forming the above oxide film, there is a method of dipping the steel sheet in an aqueous solution prepared from an aqueous solution including Mn, an aqueous solution including P, and an auxiliary agent for etching (sulfuric acid, etc.), a method of spraying the aqueous solution, and a method of electrolyzing with making a steel sheet cathode in the aqueous solution. A desirable oxide film can be formed by the methods.

An amount of Mn—P based oxide film may include 5 mg/m$^2$ or more of Mn in order to obtain good press formability. However, if the amount of Mn is more than 100 mg/m$^2$, a chemical film is not formed uniformly. Therefore, the optimum amount is 5 mg/m$^2$ or more and 100 mg/m$^2$ or less of Mn. Particularly, a galvannealed steel sheet of a low alloying degree has a good sliding property even if the amount of the Mn—P oxide film is less. The reason is not clear, and a layer formed by a reaction of a galvannealed layer of a low of Fe content and Mn is the most effective way to improve the sliding property. Therefore, it is preferable that the amount of Mn coating be 5 to 70 mg/m$^2$. When the amount of P coating is 3 mg/m$^2$ or more of P and is in accord with a mixed quantity of an aqueous solution including P and the like, film formability of Mn oxide is improved, and a better sliding property is developed as an effect. However, it is not preferable that the chemical conversion treatability be deteriorated if the amount of P coating is more than 500 mg/m$^2$. Therefore, it is preferable that the amount of P coating be from 3 to 200 mg/m$^2$.

A galvannealed steel sheet having both powdering resistance and a sliding property (flaking resistance), and excellent chemical conversion treatability and spot weldability can be produced by forming a Mn—P based oxide film as a lubricative hard film on a galvannealed steel sheet of a low alloying degree.

EXAMPLES

The examples of the present invention are described in detail.

(Hot Dip Galvanization)

Steel sheets having different amounts of C, Si, Mn, P, and Al in steel is subjected to a reduction and annealing treatment for 90 seconds at 800° C. in an atmosphere of 10% $H_2$—$N_2$. The steel sheets are galvanized by dipping for 3 seconds in a Zn hot galvanized bath of 460° C. including 0.025% of Fe and 0.13% of Al. Moreover, the coating weight is controlled by a gas wiping method so as to maintain a constant coating weight of 45 g/m$^2$. The hot dip galvanized steel sheet is heated to a temperature (T11) of a steel sheet at the exit of a heating furnace at the maximum reachable temperature, and is subjected to an alloying treatment by cooling slowly in a soaking furnace. Galvannealed steel sheets having various alloying degrees are prepared by varying the temperature integrating value S calculated by the Formula (6) in the alloying treatment.

(Appearance)

The galvannealed steel sheets were classified in the following by visual inspection: uniform appearance is "good", partly nonuniform appearance is "fair", and totally nonuniform appearance is "not good".

(Treatment of Oxide Film)

The following treatment is performed in order to form an oxide film. Electrolysis of 7 A/dm$^2$ is performed for 1.5 seconds using a 30° C. mixed solution of an aqueous solution including Mn, an aqueous solution including P, sulfuric acid, and zinc carbonate as an electrolytic bath; a steel sheet to be treated as a cathode; and a Pt electrode as an anode. The steel sheet to be treated is washed by water, is dried, and dipped in a mixed solution while controlling the concentration of an aqueous solution including Mn, an aqueous solution including P, sulfuric acid, and zinc carbonate; the temperature of the mixture solution; and the dipping period, and thereby an oxide film is formed.

(Structure of Galvannealed Layer)

The measurement area is a precise circle of 15 mm in diameter. Diffraction peaks are measured using the θ-2θ method. X-ray tube is a Cu tube. The X-ray tube voltage is 50 kV. The X-ray tube current is 250 mA.

Γ(2.59 Å), $\delta_1$(2.13 Å) and ζ(1.26 Å) were measured as intensities of diffraction peaks derived from alloy phases. Γ(2.59 Å) (cps) is a diffraction intensity of an interplanar spacing d=2.59 Å derived from Γ phase ($Fe_3Zn_{10}$) and $\Gamma_1$ phase ($Fe_5Zn_{21}$). $\delta_1$ (2.13 Å) (cps) is a diffraction intensity of an interplanar spacing d=2.13 Å derived from $\delta_1$ phase ($FeZn_7$). ζ(1.26 Å) (cps) is a diffraction intensity of an interplanar spacing d=1.26 Å derived from ζ phase ($FeZn_{13}$). Since it is difficult to distinguish between ζ phase and $\Gamma_1$ phase crystallographically, both the Γ phase and the $\Gamma_1$ phase is described as Γ phase in the present invention.

Γ(2.59 Å) is a diffraction intensity of an interplanar spacing d=2.59 Å of Γ phase.

$\delta_1$(2.13 Å) is a diffraction intensity of an interplanar spacing d=2.13 Å of $\delta_1$ phase.

ζ(1.26 Å) is a diffraction intensity of an interplanar spacing d=1.26 Å of ζ phase.

(Powdering Resistance)

Galvannealed steel sheets (GA) 40 mm wide and 250 mm long were prepared as a test sample using a crank press, and then were worked so as to have a radius of a punch shoulder of 5 mm, a radius of a die shoulder of 5 mm, and a form height of 65 mm using a die having semi-round beads of r=5 mm. After working, peeled galvannealed layers were measured, and were classified according to the following criterion for evaluation.

Criterion for Evaluation

A peeled amount of a galvannealed layer of less than 5 g/m$^2$ is very good, 5 g/m$^2$ or more and less than 10 g/m$^2$ is good, 10 g/m$^2$ or more and less than 15 g/m$^2$ is fair, and 15 g/m$^2$ or more is not good.

(Sliding Property)

A pulling load is measured by tests applying a surface pressure of 100 to 600 kgf under the following conditions: the sample size is 17 mm×300 mm, the pulling speed is 500 mm/min, the square beat shoulder R is 1.0/3.0 mm, the sliding length is 200 mm, the lubrication is NOX-RUST 530F-40 (PARKER INDUSTRY, INC.), and the amount of lubricant is 1 g/m$^2$. Friction coefficients are obtained from the slopes of a pulling load to surface pressure. The obtained friction coefficients were classified according to the following criterion for evaluation.

Criterion for Evaluation

A friction coefficient of less than 0.5 is very good, 0.5 or more and less than 0.6 is good, 0.6 or more and less than 0.8 is fair, 0.8 or more is not good.

(Chemical Conversion Treatability)

5D5000 (NIPPON PAINT Co. Ltd.) was used as a solution (a zinc-phosphoric acid-fluorine based treatment bath) for chemical conversion treatments, and a chemical conversion treatment was conducted after removal of oil and surface conditioning of galvannealed steel sheets in a prescribed manner. Chemical films were observed using SEM (secondary electron image) for the following classification of chemical conversion treatability: films formed uniformly are "good", films formed partly are "fair", and no formed films are "not good".

(Spot Weldability)

Direct spot welding is performed under the following conditions: a welding pressure of 2.01 kN, a welding time of Ts of 25 cyc., Tup of 3 cyc., Tw of 8 cyc., Th of 5 cyc., and To of 50 cyc, and a tip type of DR6 in a spherical shape. A formed nugget diameter was measured by varying the current of the direct spot welding. A current in which nuggets of 4√td or more were formed when thickness of steel sheet is td was measured as a lower limit of the current, a current in which dust was generated was measured as an upper limit of the current, and an adequate current of the difference between the upper limit of the current and the lower limit of the current was calculated. Continuous welding was performed at a constant current value of 0.9 times the upper limit of the current under the above welding conditions after a range of an adequate current of 1 kA or more is verified. A nugget diameter was measured, and the number of spot welding points having nugget diameters of 4√td or less was measured. Spot welding points of 1000 or more are "good", and spot welding points of less than 1000 are "not good".

Test results obtained in the above are summarized as shown in TABLE 1 and TABLE 2. In TABLE 1, the composition of each steel sheet was the same as the composition of C, Si, Mn, and P in steel shown in FIG. 9, that is, a typical composition of IF steels. A temperature integration value S, the amount of a Mn coating, and the amount of a P coating for each steel sheet was controlled. Since the steel sheets shown in TABLE 1 are mild steels of a lower additive amount of alloying elements and include the following components: 0.01% of Si, 0.01% of Mn, 0.005% of P and 0.001% of C, and all of the values of Z are −300. Therefore, all steel sheets of Examples and Comparative Examples are uniform of appearance. As shown in TABLE 1, all of the galvannealed steel sheets of the Examples in the present invention have excellent powdering resistance, flaking resistance (sliding property), chemical conversion treatability, and spot weldability. However, galvannealed steel sheets of the Comparative Examples which did not satisfy the requirements described in the present invention did not have enough either powdering resistance, flaking resistance, chemical conversion treatability, or spot weldability.

In TABLE 2, steel sheets having various compositions of C, Si, Mn, P in steel were used, and the temperature integration value S, the amount of Mn coating, and the amount of P coating were controlled. As shown in TABLE 2, all galvannealed steel sheets of Examples in the present invention had an excellent quality of appearance, powdering resistance, flaking resistance (sliding property), chemical conversion treatability, and spot weldability. However, galvannealed steel sheets of the Comparative Examples which did not satisfy the requirements described in the present invention did not have a good enough quality of appearance, powdering resistance, flaking resistance, chemical conversion treatability, and spot weldability.

TABLE 1

| | S | Fe Concentration in Galvannealed Layer (%) | Temperature at the Exit of Heating Furnace T11(° C.) | Temperature at the Exit of Soaking Furnace T22(° C.) | Γ (2.59 Å) (cps) | ζ (1.26 Å) (cps) | Amount of Mn Coating (mg/m$^2$) |
|---|---|---|---|---|---|---|---|
| 1 | 500 | 9 | 490 | 420 | 0 | 300 | 5 |
| 2 | 700 | 9.8 | 490 | 430 | 10 | 260 | 10 |
| 3 | 900 | 10.3 | 490 | 450 | 50 | 180 | 10 |
| 4 | 1000 | 10.5 | 490 | 460 | 100 | 100 | 10 |
| 5 | 900 | 10.3 | 490 | 450 | 50 | 180 | 70 |
| 6 | 900 | 10.3 | 490 | 450 | 50 | 180 | 5 |
| 7 | 900 | 10.3 | 490 | 450 | 50 | 180 | 80 |
| 8 | 900 | 10.3 | 490 | 450 | 50 | 180 | 100 |
| 9 | 900 | 10.3 | 490 | 450 | 50 | 180 | 5 |
| 10 | 900 | 10.3 | 490 | 450 | 50 | 180 | 5 |
| 11 | 1100 | 10.8 | 510 | 450 | 110 | 20 | 10 |
| 12 | 400 | 8.8 | 470 | 420 | 0 | 350 | 10 |
| 13 | 1050 | 10.7 | 500 | 450 | 105 | 40 | 100 |
| 14 | 900 | 10.3 | 490 | 450 | 50 | 180 | 110 |
| 15 | 900 | 10.3 | 490 | 450 | 50 | 180 | 5 |

| | Amount of P Coating (mg/m$^2$) | Sliding Property | Powdering Resistance | Chemical Conversion Treatability | Weldability | Description |
|---|---|---|---|---|---|---|
| 1 | 3 | very good | very good | good | good | Example |
| 2 | 10 | very good | very good | good | good | Example |
| 3 | 10 | very good | very good | good | good | Example |
| 4 | 10 | very good | very good | good | good | Example |
| 5 | 3 | very good | very good | good | good | Example |
| 6 | 200 | very good | very good | good | good | Example |
| 7 | 10 | good | good | good | good | Example |
| 8 | 10 | good | good | good | good | Example |
| 9 | 300 | good | good | good | good | Example |
| 10 | 500 | good | good | good | good | Example |
| 11 | 10 | fair | fair | good | good | Comparative Example |
| 12 | 10 | very good | very good | good | not good | Comparative Example |
| 13 | 300 | fair | good | good | good | Comparative Example |
| 14 | 10 | very good | very good | fair | good | Comparative Example |
| 15 | 1100 | very good | very good | fair | good | Comparative Example |

※Columns beyond the scope of the present invention are underlined.

TABLE 2

| | C (%) | Si (%) | Mn (%) | P (%) | Al (%) | X | Y | S | Fe Concentration of Galvannealed Layer (%) | V (° C./sec) | Temperature at the Exit of Heating Furnace T11 (° C.) | Temperature at the Exit of Soaking Furnace T22 (° C.) | Γ (2.59 Å) (cps) | ζ (1.26 Å) (cps) | Amount of Mn Coating (mg/m$^2$) | Amount of P Coating (mg/m$^2$) | Difference In Thickness of Galvannealed Layer (%) | Quality of Appearance | Sliding Property | Powdering Resistance | Chemical Conversion Treatability | Weldability | Description |
|---|---|---|---|---|---|---|---|---|---|---|---|---|---|---|---|---|---|---|---|---|---|---|---|
| 1 | 0.0001 | 0.01 | 0.01 | 0.01 | 0.0001 | 681.1 | 1181.1 | 681 | 9 | 40 | 490 | 420 | 0 | 300 | 5 | 3 | 12 | good | very good | very good | good | good | Example |
| 2 | 0.15 | 2 | 1 | 0.1 | 2 | 7558 | 8058 | 7558 | 9 | 50 | 630 | 450 | 0 | 300 | 5 | 3 | 14 | good | very good | very good | good | good | Example |
| 3 | 0.3 | 4 | 2 | 0.2 | 4 | 14808 | 15308 | 14810 | 9 | 60 | 670 | 480 | 0 | 300 | 5 | 3 | 15 | good | very good | very good | good | good | Example |
| 4 | 0.004 | 0.04 | 0.5 | 0.02 | 0.01 | 1564 | 2064 | 1570 | 9 | 45 | 580 | 450 | 0 | 300 | 6 | 3 | 14 | good | very good | very good | good | good | Example |
| 5 | 0.004 | 0.04 | 0.5 | 0.02 | 0.01 | 1564 | 2064 | 1770 | 9.8 | 50 | 600 | 430 | 10 | 260 | 10 | 10 | 13 | good | very good | very good | good | good | Example |
| 6 | 0.004 | 0.04 | 0.5 | 0.02 | 0.01 | 1564 | 2094 | 1970 | 10.3 | 55 | 620 | 450 | 50 | 180 | 10 | 10 | 18 | good | very good | very good | good | good | Example |
| 7 | 0.004 | 0.04 | 0.5 | 0.02 | 0.01 | 1564 | 2064 | 2060 | 10.5 | 60 | 630 | 460 | 100 | 100 | 10 | 10 | 19 | good | very good | very good | good | good | Example |
| 8 | 0.004 | 0.04 | 0.5 | 0.02 | 0.01 | 1564 | 2064 | 1970 | 10.3 | 55 | 620 | 450 | 50 | 180 | 70 | 3 | 17 | good | very good | very good | good | good | Example |
| 9 | 0.004 | 0.04 | 0.5 | 0.02 | 0.01 | 1564 | 2064 | 1970 | 10.3 | 55 | 620 | 450 | 50 | 180 | 5 | 200 | 17 | good | very good | very good | good | good | Example |
| 10 | 0.004 | 0.04 | 0.5 | 0.02 | 0.01 | 1564 | 2064 | 1970 | 10.3 | 55 | 620 | 450 | 50 | 180 | 80 | 10 | 16 | good | good | good | good | good | Example |
| 11 | 0.004 | 0.04 | 0.5 | 0.02 | 0.01 | 1564 | 2064 | 1970 | 10.3 | 55 | 620 | 450 | 50 | 180 | 100 | 10 | 17 | good | good | good | good | good | Example |
| 12 | 0.004 | 0.04 | 0.5 | 0.02 | 0.01 | 1564 | 2064 | 1970 | 10.3 | 55 | 620 | 450 | 50 | 180 | 5 | 300 | 17 | good | good | good | good | good | Example |
| 13 | 0.004 | 0.04 | 0.5 | 0.02 | 0.01 | 1564 | 2064 | 1970 | 10.3 | 55 | 620 | 450 | 50 | 180 | 5 | 500 | 16 | good | good | good | good | good | Example |
| 14 | 0.1 | 1 | 2 | 0.07 | 0.02 | 6158 | 6658 | 6160 | 9 | 45 | 610 | 450 | 0 | 300 | 5 | 3 | 11 | good | very good | very good | good | good | Example |
| 15 | 0.1 | 1 | 2 | 0.07 | 0.02 | 6158 | 6658 | 6360 | 9.8 | 50 | 630 | 430 | 10 | 260 | 10 | 10 | 12 | good | very good | very good | good | good | Example |
| 16 | 0.1 | 1 | 2 | 0.07 | 0.02 | 6158 | 6658 | 6560 | 10.3 | 55 | 650 | 450 | 50 | 180 | 10 | 10 | 17 | good | very good | very good | good | good | Example |
| 17 | 0.1 | 1 | 2 | 0.07 | 0.02 | 6158 | 6658 | 6650 | 10.5 | 60 | 660 | 460 | 100 | 100 | 10 | 10 | 19 | good | very good | very good | good | good | Example |
| 18 | 0.1 | 1 | 2 | 0.07 | 0.02 | 6158 | 6658 | 6560 | 10.3 | 55 | 650 | 450 | 60 | 180 | 70 | 3 | 18 | good | very good | very good | good | good | Example |
| 19 | 0.1 | 1 | 2 | 0.07 | 0.02 | 6158 | 6658 | 6560 | 10.3 | 55 | 650 | 450 | 50 | 180 | 5 | 200 | 16 | good | very good | very good | good | good | Example |
| 20 | 0.1 | 1 | 2 | 0.07 | 0.02 | 6158 | 6658 | 6560 | 10.3 | 55 | 650 | 450 | 50 | 180 | 80 | 10 | 17 | good | good | good | good | good | Example |
| 21 | 0.1 | 1 | 2 | 0.07 | 0.02 | 6158 | 6668 | 6560 | 10.3 | 55 | 650 | 450 | 50 | 180 | 100 | 10 | 18 | good | good | good | good | good | Example |
| 22 | 0.1 | 1 | 2 | 0.07 | 0.02 | 8158 | 6658 | 6560 | 10.3 | 55 | 650 | 450 | 50 | 180 | 5 | 300 | 17 | good | good | good | good | good | Example |
| 23 | 0.1 | 1 | 2 | 0.07 | 0.02 | 6158 | 6658 | 6560 | 10.3 | 55 | 650 | 450 | 50 | 180 | 5 | 500 | 16 | good | good | good | good | good | Example |

TABLE 2-continued

| | C (%) | Si (%) | Mn (%) | P (%) | Al (%) | X | Y | S | Fe Concentration of Galvannealed Layer (%) | V (° C./sec) | Temperature at the Exit of Heating Furnace T11 (° C.) | Temperature at the Exit of Soaking Furnace T22 (° C.) | Γ (2.59 Å) (cps) | ζ (1.26 Å) (cps) | Amount of Mn Coating (mg/m$^2$) | Amount of P Coating (mg/m$^2$) | Difference In Thickness of Galvannealed Layer (%) | Quality of Appearance | Sliding Property | Powdering Resistance | Chemical Conversion Treatability | Weldability | Description |
|---|---|---|---|---|---|---|---|---|---|---|---|---|---|---|---|---|---|---|---|---|---|---|---|
| 1 | 0.004 | 0.04 | 0.5 | 0.02 | 0.01 | 1564 | 2064 | 2150 | 10.8 | 60 | 660 | 460 | 110 | 20 | 10 | 10 | 21 | fair | fair | fair | good | good | Comparative Example |
| 2 | 0.004 | 0.04 | 0.5 | 0.02 | 0.01 | 1564 | 2064 | 1450 | 8.8 | 45 | 610 | 450 | 0 | 350 | 10 | 10 | 11 | good | very good | very good | good | not good | Comparative Example |
| 3 | 0.004 | 0.04 | 0.5 | 0.02 | 0.01 | 1564 | 2064 | 2110 | 10.7 | 60 | 660 | 460 | 105 | 40 | 100 | 300 | 17 | good | fair | good | good | good | Comparative Example |
| 4 | 0.004 | 0.04 | 0.5 | 0.02 | 0.01 | 1564 | 2064 | 1970 | 10.3 | 55 | 650 | 450 | 50 | 180 | 110 | 10 | 16 | good | very good | very good | fair | good | Comparative Example |
| 5 | 0.004 | 0.04 | 0.5 | 0.02 | 0.01 | 1564 | 2064 | 1970 | 10.3 | 55 | 650 | 450 | 50 | 180 | 5 | 1100 | 18 | good | very good | very good | fair | good | Comparative Example |
| 6 | 0.004 | 0.04 | 0.5 | 0.02 | 0.01 | 1564 | 2064 | 1970 | 10.3 | 62 | 620 | 450 | 50 | 180 | 10 | 10 | 33 | fair | very good | very good | good | good | Comparative Example |
| 7 | 0.004 | 0.04 | 0.5 | 0.02 | 0.01 | 1564 | 2064 | 1970 | 10.3 | 70 | 620 | 450 | 50 | 180 | 10 | 10 | 62 | not good | very good | very good | good | good | Comparative Example |
| 8 | 0.31 | 4.1 | 2.1 | 0.21 | 4.1 | 15398 | 15898 | 15350 | 8.5 | 65 | 670 | 490 | 0 | 600 | 10 | 10 | 17 | good | fair | very good | good | not good | Comparative Example |

·X·Columns beyond the scope of the present invention are underlined.

Here, $X = 850 + 1300 \times (\%\,Si - 0.03) + 1000 \times (\%\,Mn - 0.15) + 35000 \times (\%\,P - 0.01) + 1000 \times (\%\,C - 0.003)$, and $Y = 1350 + 1300 \times (\%\,Si - 0.03) + 1000 \times (\%\,Mn - 0.15) + 35000 \times (\%\,P - 0.01) + 1000 \times (\%\,C - 0.003)$.

INDUSTRIAL APPLICABILITY

The present invention provides a galvannealed steel sheet having both flaking resistance and powdering resistance, a good surface quality of appearance, and excellent chemical conversion treatability, and a producing method therefor.

REFERENCE SYMBOL LIST

2: STEEL SHEET
8: HOT GALVANIZING BATH (POT)
9: HEATING FURNACE
10: SOAKING FURNACE
11: RAPID COOLING ZONE
21: GALVANNEALED LAYER (Zn—Fe ALLOY)
24: GALVANNEALED STEEL SHEET
25: GALVANNEALED STEEL SHEET TREATED BY OXIDE FILM (GALVANNEALED STEEL SHEET)
30: ζ PHASE
31: $\delta_1$ PHASE
32: Γ PHASE
40: Mn—P BASED OXIDE FILM

What is claimed is:

1. A galvannealed steel sheet comprising:
a steel sheet;
a galvannealed layer; and
a Mn—P based oxide film, wherein:
the steel sheet comprises C, Si, Mn, P, Al, and balance composed of Fe and inevitable impurities;
a Zn—Fe alloy phase in the galvannealed layer is measured by X-ray diffractometry,
wherein a value of a diffraction intensity Γ(2.59 Å) corresponding to an interplanar spacing of d=2.59 Å of Γ phase divided by a diffraction intensity $\delta_1$(2.13 Å) corresponding to an interplanar spacing of d=2.13 Å of $\delta_1$ phase is less than or equal to 0.1, and
a diffraction intensity ζ(1.26 Å) corresponding to an interplanar spacing of d=1.26 Å of phase divided by a diffraction intensity $\delta_1$(2.13 Å) corresponding to an interplanar spacing of d=2.13 Å of $\delta_1$ phase is greater than or equal to 0.1 and less than or equal to 0.4; and
the Mn—P based oxide film is formed using 5 to 100 mg/m$^2$ of Mn and 3 to 500 mg/m$^2$ of P on a surface of the galvannealed layer.

2. The galvannealed steel sheet according to claim 1, wherein the steel sheet comprising the following component:
0.0001 to 0.3 mass % of C;
0.01 to 4 mass % of Si;
0.01 to 2 mass % of Mn;
0.002 to 0.2 mass % of P; and
0.0001 to 4 mass % of Al.

3. The galvannealed steel sheet according to claim 1, wherein the galvannealed layer is measured by X-ray diffractometry of Zn—Fe alloy phase, in which the diffraction intensity Γ(2.59 Å) corresponding to the interplanar spacing of d=2.59 Å of the Γ phase is less than or equal to 100 cps and the diffraction intensity ζ(1.26 Å) corresponding to the interplanar spacing of d=1.26 Å of the ζ phase is greater than or equal to 100 cps and less than or equal to 300 cps.

4. The galvannealed steel sheet according to claim 1, wherein an amount of Fe in the Zn—Fe alloy phase of the galvannealed layer is greater than or equal to 9.0 and less than or equal to 10.5 mass %.

5. A method for producing a galvannealed steel sheet, the method comprising:
performing hot dip galvanization of a steel sheet;
forming an galvannealed layer using an alloying treatment of heating in a heating furnace followed by slow cooling in a soaking furnace after the temperature of the steel sheet reaches the maximum reachable temperature at the exit of the heating furnace; and
forming a Mn—P based oxide film including Mn and P on a surface of the galvannealed layer,
wherein in the alloying treatment,
a temperature integration value S is calculated by $$S=(T11-T0)\times t1/2+((T11-T0)+(T12-T0))\times t2/2+((T12-T0)+(T21-T0))\times \Delta t/2+((T21-T0)+(T22-T0))\times t3/2+(T22-T0)\times t4/2, \text{ and}$$

S satisfies the formula 850+Z≦S≦1350+Z,
using a composition dependent coefficient Z represented by $$Z=1300\times(\%\ Si-0.03)+1000\times(\%\ Mn-0.15)+35000\times(\%\ P-0.01)+1000\times(\%\ C-0.003),$$

where T0 is 420° C., T11(° C.) is a temperature of the steel sheet at the exit of the heating furnace, T12(° C.) is a temperature of the steel sheet at the entry of the cooling zone in the soaking furnace, T21(° C.) is a temperature of the steel sheet at the exit of the cooling zone in the soaking furnace, T22(° C.) is a temperature of the steel sheet at the exit of the soaking furnace, t1 (s) is a treating time from an initial position of T0 to the exit of the heating furnace, t2(s) is a treating time from the exit of the heating furnace to the entry of the cooling zone in the soaking furnace, Δt(s) is a treating time from the entry of the cooling zone to the exit of the cooling zone in the soaking furnace, t3(s) is a treating time from the exit of the cooling zone in the soaking furnace to the exit of the soaking furnace, t4(s) is a treating time from the entry of the quenching zone to a final position of T0, and % Si, % Mn, % P, and % C are the amounts (by mass %) of the respective elements in steel; and
the Mn—P based oxide film is formed using 5 to 100 mg/m$^2$ of Mn and 3 to 500 mg/m$^2$ of P on a surface of the galvannealed layer.

6. The method for the galvannealed steel sheet according to claim 5, wherein in the heating furnace for heating of the steel sheet, a heating rate V calculated by V=(T11−T0)/t1 is controlled under a condition of a low heating rate of less than or equal to 100° C./s if Z is less than 700; and is controlled under a condition of a low heating rate of less than 60° C./s or equal to if Z is greater than or equal to 700.

7. The method for the galvannealed steel sheet according to claim 5, wherein the steel sheet comprises the following components:
0.0001 to 0.3 mass % of C;
0.01 to 4 mass % of Si;
0.01 to 2 mass % of Mn;
0.002 to 0.2 mass % of P; and
0.0001 to 4 mass % of Al.

* * * * *

UNITED STATES PATENT AND TRADEMARK OFFICE

CERTIFICATE OF CORRECTION

PATENT NO. : 8,404,358 B2
APPLICATION NO. : 13/138309
DATED : March 26, 2013
INVENTOR(S) : Kurosaki et al.

It is certified that error appears in the above-identified patent and that said Letters Patent is hereby corrected as shown below:

In the Specification

Column 9, line 49, change "NOX-RUST 530E-40" to -- NOX-RUST 530F-40 --;

Column 18, line 6, change "ζ phase" to -- Γ phase --;

Column 22, Table 2, column X, change "8158" to -- 6158 --;

In the Claims

Column 25, line 38, Claim 1, change "d = 1.26 Å of phase" to -- d = 1.26 Å of ζ phase --.

Signed and Sealed this
Twenty-fourth Day of December, 2013

Margaret A. Focarino

Margaret A. Focarino
*Commissioner for Patents of the United States Patent and Trademark Office*